US009891009B2

(12) United States Patent
Lang

(10) Patent No.: US 9,891,009 B2
(45) Date of Patent: Feb. 13, 2018

(54) TUBE FOR HEAT TRANSFER

(71) Applicant: Luvata Espoo Oy, Espoo (FI)

(72) Inventor: Yanping Lang, Guangdong (CN)

(73) Assignee: LUVATA ALLTOP (ZHONGSHAN) LTD., Zhongshan (CN)

( * ) Notice: Subject to any disclaimer, the term of this patent is extended or adjusted under 35 U.S.C. 154(b) by 38 days.

(21) Appl. No.: 14/905,540

(22) PCT Filed: Jul. 11, 2014

(86) PCT No.: PCT/EP2014/064939
§ 371 (c)(1),
(2) Date: Jan. 15, 2016

(87) PCT Pub. No.: WO2015/007645
PCT Pub. Date: Jan. 22, 2015

(65) Prior Publication Data

US 2016/0138877 A1 May 19, 2016

(30) Foreign Application Priority Data

Jul. 18, 2013 (CN) ..... 2013 1 0301247

(51) Int. Cl.
*F28F 1/30* (2006.01)
*F28F 1/40* (2006.01)

(52) U.S. Cl.
CPC ..... *F28F 1/40* (2013.01); *F28F 2215/04* (2013.01)

(58) Field of Classification Search
CPC .. F28F 1/40; F28F 2215/04; F28F 1/32; F28F 1/0233; F28F 1/05333; B21C 23/10
USPC ..... 165/182
See application file for complete search history.

(56) References Cited

U.S. PATENT DOCUMENTS 2,930,405 A * 3/1960 Welsh ..... B21C 37/225 138/38
4,154,296 A * 5/1979 Fijas ..... F28F 1/32 138/38
5,655,599 A * 8/1997 Kasprzyk ..... F28F 1/40 165/133
2007/0089868 A1 4/2007 Houfuku
2009/0294112 A1 12/2009 Reifel

FOREIGN PATENT DOCUMENTS

EP 1482269 12/2004
JP S604797 1/1985
WO 02084197 10/2002

* cited by examiner

*Primary Examiner* — Davis Hwu
(74) *Attorney, Agent, or Firm* — JCIPRNET

(57) ABSTRACT

A tube for heat transfer in which the inner surface of the tube is grooved into a pattern. The pattern includes a first fin (10) and a second fin (20) which have different shapes, wherein the first fin comprises a shaft and a head integrally formed, the shaft extending from the inner surface in a direction away from the inner surface, the head extending from the shaft in a direction away from the inner surface. In a transverse cross section of the tube, the circumferential width of the head is larger than that of the shaft.

15 Claims, 1 Drawing Sheet

TUBE FOR HEAT TRANSFER

TECHNICAL FIELD

The present invention relates to a tube for heat transfer, in particular, to an inner-grooved tube for heat transfer with two types of fins in the inner surface thereof.

BACKGROUND

Seamless tubes, especially those made of materials of high heat-conductivity such as copper and aluminum, are used in heat exchangers to circulate heat-carrying fluid to transfer heat. Such tubes are internally grooved to increase the area of the inner surface for improve heat exchange area between the heat-carrying fluid and the inner surface of the tube and to generate turbulence, which improves heat exchange efficiency.

Employing an inner-grooved tube instead of one with a smooth inner surface in a heat exchanger significantly improves heat exchange efficiency and thus saves energy for environment protection. Notwithstanding the improved efficiency, previous inner-grooved tubes, due to the limitation of maximum hear transfer capacity, cannot satisfy the heat dissipation requirements for some large power equipment.

SUMMARY OF THE INVENTION

It is an object of the present disclosure to provide an inner-grooved tube with improved heat exchange efficiency.

The present disclosure is directed to a tube for heat transfer, the inner surface of the tube is grooved into a pattern, the pattern including a first fin and a second fin which have different shapes, wherein the first fin comprising a shaft and a head integrally formed, the shaft extending from the inner surface in a direction away from the inner surface, the head extending from the shaft in a direction away from the inner surface, in a transverse cross section of the tube, the circumferential width of the head is larger than that of the shaft.

The present inner-grooved tube for heat transfer, increases the heat transfer area and the capillary driving force, and thus improves the heat transfer capacity and heat transfer efficiency.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION

Figure 1:
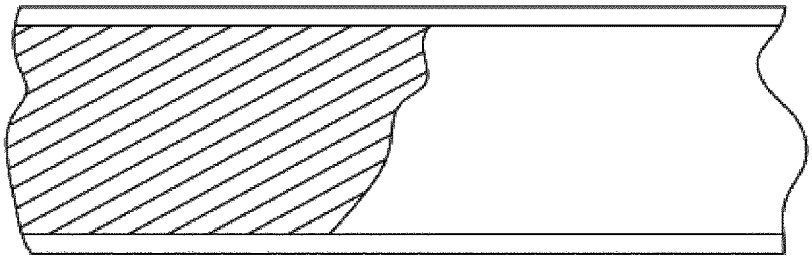
FIG. 1 shows a longitudinal cross-sectional view of an inner-grooved tube according to one embodiment of the present disclosure.

FIG. 1 shows a longitudinal cross-sectional view of an inner-grooved tube 1 according to one embodiment of the present disclosure. The tube is seamless as it is made through drawing a solid billet over a piercing rod to create a hollow shell (in contrast, a welded tube is made by rolling a plate and welding two edges of the plate); the tube, however, may also be a welded one. The inner surface of the tube is grooved into a pattern. Although the tube shown in FIG. 1 is internally threaded, i.e., its inner surface is grooved into a helical thread, one skilled in the art knows that the inner surface can be grooved into any suitable pattern, e.g. a plurality of ribs extending along the longitudinal axis of the tube, or a helix on the inner surface of the tube.

Figure 2:
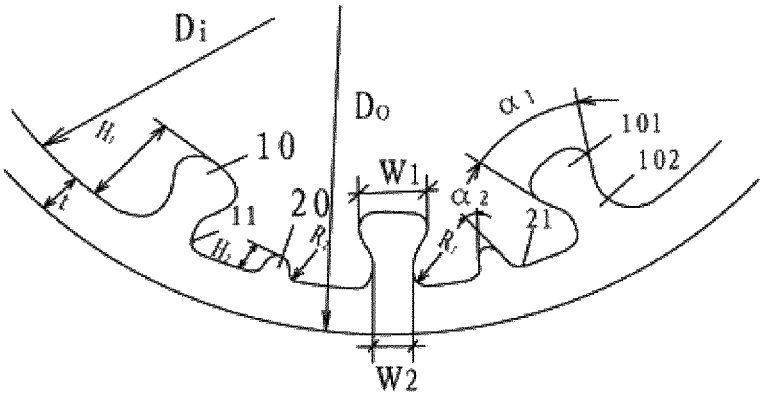
FIG. 2 shows a transverse cross-sectional view of an inner-grooved tube according to one embodiment of the present disclosure.

FIG. 2 shows a transverse cross-sectional view of an inner-grooved tube 1 according to one embodiment of the present disclosure. The tube 1 shown in FIG. 2 has a round cross section. The cross section of the tube, as understood by one skilled in the art, could be a plate shape, a rectangular shape or any other shape appropriate for a particular application. The tube 1 shown in FIG. 2 has an outer diameter Do, an inner diameter Di and a wall thickness t.

The inner surface of the tube 1 is grooved into a pattern, the pattern including a first fin 10 and a second fin 20. The first fin 10 and the second fin 20 each extend at an angle with respect to the longitudinal direction of the tube so as to form inner threads on the inner surface of the tube. The angle between the internal threads and the longitudinal axis of the tube is 0° to 60°, preferably 2° to 45°. The first fin 10 and the second fin 20 each have a constant transversal cross section along the longitudinal direction of the tube.

The first fin 10 and the second fin 20 have different shapes, wherein the first fin 10 comprises a shaft 102 (i.e., a ridge) and a head 101 integrally formed with the shaft 102. The shaft 102 extends from the inner surface in a direction away from the inner surface, and the head 101 extends from the shaft 102 in a direction away from the inner surface. In a transverse cross section of the tube, the circumferential width W1 of the head 101 is larger than that W2 of the shaft 102. The fin height in a radial direction of the first fin 10 is H1, wherein the height the head 101 is less than or equal to that of the shaft 102. Preferably, the width W1 in a circumferential direction of the head 101 either increases with the head extending away from the inner surface, or first increases with the head extending away from the inner surface and then decreases toward the tip of the head. The width W2 in a circumferential direction of the shaft 102 may be constant with the shaft extending away from the inner surface.

As shown in FIG. 2, the addendum angle of the first fin 10 is $\alpha 1$. The dedendum of the first fin 10 is smoothly connected, at the first corner 11, to the inner surface of the tube 1 with a curve transition. The curvature of the first corner 11 is R1. For instance, H1 may be 0.05 mm to 0.30 mm and R1 may be 0 to 0.15 mm.

The height in a radial direction of the second fin 20 is H2 which is lower than the height H1 of the first fin 10. Preferably, the height H2 of the second fin 20 is ⅓ to ½ of the height H1 of the first fin 10. The width at the top of the second fin 20, i.e. the addendum width, is narrower than the width at the bottom the second fin 20, i.e. the dedendum width. Preferably, the width in a circumferential direction of the second fin 20 decreases with the second fin 20 extending away from the inner surface. As shown in FIG. 2, the addendum angle of the second fin 20 is $\alpha 2$ which is 5° to 60°. The dedendum of the second fin 20 is smoothly connected, at the second corner 21, to the inner surface of the tube 1 with a curve transition. The curvature of the second corner 21 is R2. For instance, H2 may be 0.005 mm to H1 and R2 may be 0 to 0.15 mm.

In the embodiment shown in FIG. 2, the circumferential fin number N1 of the first fin 10 is identical to the circumferential fin number N2 of the second fin 20. The first fin 10 and the second fin 20 are alternately arranged. The fin height H1 of the first fin 10 is larger than the fin height H2 of the second fin 20. For instance, the fin height H2 is between 0.005 mm and the fin height H1.

Figure 3:
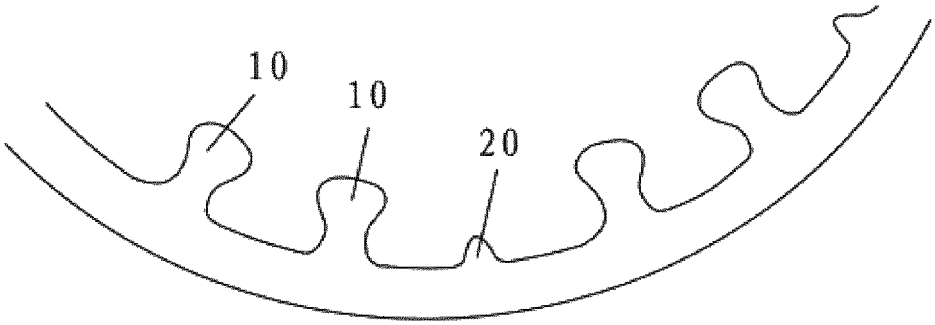
FIG. 3 shows a transverse cross-sectional view of an inner-grooved tube according to another embodiment of the present disclosure.

The alternately arranged first fin 10 and second fin 20 can increase the area of the inner surface of the tube, increase the heat transfer area between heat carrying fluid and the inner surface of the tube, and provide higher heat transfer efficiency. In addition, the cavity forms between the first fin 10 and the second fin 20 improve the capillary effects of the tube, provide strong capillary driving force and thus improve the heat transfer performance FIG. 3 shows the transverse cross-sectional view of an inner grooved tube 1' according to another embodiment of the present disclosure. Identical to the previous embodiment, the internal threads on the inner surface of the tube 1' also includes a first fin 10' and a second fin 20'. The present embodiment differs from the previous embodiment only in that, the circumferential fin number N1 of the first fin 10' is twice of the circumferential fin number N2 of the second fin 20'. Every two first fins 10' and one second fin 20' are alternately arranged. However, one skilled in the art understands that, the circumferential fin number N1 of the first fin 10' can be any other integral times of the circumferential fin number N2 of the second fin 20', and the second fin is spaced by the first fins. Alternatively, as long as the first fin and the second fin are alternately arranged, the circumferential fin number N1 of the first fin 10' does not have to be integral times of the circumferential fin number N2 of the second fin 20'.

Moreover, provided that the addendum width is larger than the width at the half of the height of the first fin, the first fin 10 is not limited to the shape as shown in FIGS. 2 and 3. For instance, the first fin 10 could be approximately inversed trapezoid. Provided that the addendum width is smaller than the dedendum width, the second fin 20 is not limited to the shape as shown in FIGS. 2 and 3. For instance, the second fin 20 could be approximately trapezoid. In these situations, the height of the second fin 20 shall be lower than that of the first fin 10.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

Other embodiments of the disclosure will be apparent to those skilled in the art from consideration of the specification and practice of the disclosure disclosed herein. It is intended that the specification and examples be considered as exemplary only, with the true scope and spirit of the invention being indicated by the following claims.

The invention claimed is:

1. A tube for heat transfer, an inner surface of the tube being grooved into a pattern, the pattern including a first fin and a second fin which have different shapes, wherein the first fin comprises a shaft and a head integrally formed, the shaft extending from the inner surface in a direction away from the inner surface, the head extending from the shaft in the direction away from the inner surface, characterized in that in a transverse cross section in respect of a longitudinal axis of the tube, a circumferential width of the head is larger than that of the shaft, wherein a number of the first fin in a circumference of the tube is an integer multiple of a number of the second fin in the circumference of the tube, wherein the integer multiple is greater than or equal to two, and the second fin is spaced by the first fin.

2. The tube according to claim 1, wherein in the transverse cross section of the tube, a fin height in a radial direction of the first fin is higher than that of the second fin.

3. The tube according to claim 2, wherein the height of the second fin is ⅓ to ½ of the height of the first fin.

4. The tube according to claim 1, wherein the number of the first fin in the circumference of the tube is the same as the number of the second fin in the circumference of the tube, and the first fin and the second fin are alternately arranged.

5. The tube according to claim 1, wherein in the transverse cross section of the tube, a height in a radial direction of the head is less than or equal to that of the shaft.

6. The tube according to claim 1, wherein in the transverse cross section of the tube, a width in a circumferential direction of the head either increases with the head extending away from the inner surface, or first increases with the head extending away from the inner surface and then decreases toward the tip of the head.

7. The tube according to claim 6, wherein in the transverse cross section of the tube, a width in a circumferential direction of the shaft is constant with the shaft extending away from the inner surface.

8. The tube according to claim 1, wherein in the transverse cross section of the tube, a width in a circumferential direction of the second fin decreases with the second fin extending away from the inner surface.

9. The tube according to claim 8, wherein an addendum angle of the second fin is 5° to 60°.

10. The tube according to claim 1, wherein a dedendum of the first fin and that of the second fin are smoothly connected, at a first corner and a second corner respectively, to the inner surface of the tube with a curve transition.

11. The tube according to claim 1, wherein the first fin and the second fin each extends at an angle with respect to the longitudinal axis of the tube so as to form inner threads on the inner surface of the tube.

12. The tube according to claim 11, wherein the first fin and the second fin each has constant transversal cross section along the longitudinal direction of the tube.

13. The tube according to claim 11, wherein an angle between the internal threads and the longitudinal axis of the tube is 0° to 60°.

14. The tube according to claim 13, wherein the angle between the internal threads and the longitudinal axis of the tube is 2° to 45°.

15. The tube according to claim 1, wherein the tube is seamless.

* * * * *